US007420882B2

(12) United States Patent
Goeller

(10) Patent No.: US 7,420,882 B2
(45) Date of Patent: Sep. 2, 2008

(54) TIMEPIECE WITH A STRIKING WORK INCLUDING AN ISOLATING LEVER

(75) Inventor: Eric Goeller, Les Hopitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/951,486

(22) Filed: Dec. 6, 2007

(65) Prior Publication Data

US 2008/0144448 A1 Jun. 19, 2008

(30) Foreign Application Priority Data

Dec. 13, 2006 (EP) ..... 06126042

(51) Int. Cl.
*G04B 21/02* (2006.01)
*G04B 25/00* (2006.01)

(52) U.S. Cl. ..... 368/75; 368/267; 368/269

(58) Field of Classification Search ..... 368/72–75, 368/145–147, 190–199, 206–216, 243, 244, 368/246, 265–271, 319–320
See application file for complete search history.

(56) References Cited

U.S. PATENT DOCUMENTS

| | | | | |
|---|---|---|---|---|
| 2,074,025 A | | 3/1937 | Porter | |
| 2,538,161 A | * | 1/1951 | Morganson | 368/260 |
| 2,799,334 A | * | 7/1957 | Schwab | 368/246 |
| 3,349,555 A | * | 10/1967 | Bridevaux | 368/244 |
| 3,460,339 A | | 8/1969 | Schnieder | |
| 7,021,819 B2 | * | 4/2006 | Schmiedchen | 368/147 |
| 7,192,181 B2 | * | 3/2007 | Schmiedchen | 368/140 |
| 7,322,742 B2 | | 1/2008 | Goeller | |

FOREIGN PATENT DOCUMENTS

| | | |
|---|---|---|
| CH | 689 337 A5 | 2/1999 |
| EP | 1 429 214 A1 | 6/2004 |

OTHER PUBLICATIONS

European Search Report issued in corresponding application No. EP 06 12 6042, completed Aug. 14, 2007.
Notice of Allowance issued in co-pending U.S. Appl. No. 11/951,510, dated Jul. 1, 2008.

* cited by examiner

*Primary Examiner*—Vit W Miska
(74) *Attorney, Agent, or Firm*—Griffin & Szipl, P.C.

(57) ABSTRACT

The timepiece includes a striking mechanism (20) which includes a mobile part (60, 70), and a time-setting mechanism (16) which cooperates with a winding stem (26). The time-setting mechanism (16) includes a pull-out piece (50) whose pivoting is controlled by a time-setting lever (30). The pull-out piece (50) controls the sliding of a sliding pinion (36) from a winding position to a time-setting position. The pivoting of an isolating lever (94) is controlled by the mobile part (70) of the striking mechanism (20) so as to cause the sliding pinion (36) to slide from the winding position to an intermediate position, located axially between the winding position and the time-setting position thereof.

16 Claims, 2 Drawing Sheets

TIMEPIECE WITH A STRIKING WORK INCLUDING AN ISOLATING LEVER

CROSS REFERENCE TO RELATED APPLICATIONS

This application claims priority from European Patent Application No. 06126042.8, filed Dec. 13, 2006, the entire disclosure of which is incorporated herein by reference.

FIELD OF THE INVENTION

The invention concerns a timepiece with a striking work including an isolating lever.

BACKGROUND OF THE INVENTION

The invention concerns more specifically a timepiece including a striking work mechanism that includes a mobile part moving when the striking work is released, the timepiece further including a time-setting mechanism which cooperates with a winding stem, the time-setting mechanism including a time-setting lever that pivots between an angular rest position and an angular time-setting position, and a pull-out piece whose pivoting is controlled, by the time-setting lever, between a winding position and a time-setting position, the pull-out piece controlling the axial sliding of a sliding pinion from a winding position to a time-setting position.

A timepiece of this type is disclosed for example in EP Patent No. 1 429 214. That document provides a locking lever that abuts against the minute rack of the striking mechanism and that pivots to a locked time-setting position when the striking work is released. In this locked position, a pin carried by the pull-out piece is received in a notch of the locking lever, which prevents the pull-out piece from pivoting.

This timepiece thus locks the time-setting mechanism when the striking work is released, but the winding function is not neutralised. Consequently, the user can wind the timepiece movement while the striking work is being released by manipulating the winding crown of the timepiece. This mode of operation is unsatisfactory since the winding can cause malfunctions in the striking mechanism, as some parts can be locked after winding. Moreover, an acceleration phenomenon in the sound effect of the striking work may occur due to winding. These phenomena are particularly inconvenient in the case of a "single-barrel" timepiece, i.e. one that includes only one barrel common to the striking mechanism and the timepiece movement, but they may also be inconvenient in the case of a "double barrel" timepiece, i.e. one including one barrel for the striking work and one barrel for the timepiece movement.

Since the user is not always entirely familiar with the working of the timepiece and the complications thereof, it regularly occurs that ill-advised manipulations, such as winding during the release of the striking work, are carried out despite warnings, which may require returning the timepiece to after-sales service.

SUMMARY OF THE INVENTION

It is an object of the present invention to overcome these drawbacks by providing a timepiece fitted with a simple and reliable mechanism for preventing winding during the operation of the striking work.

The invention therefore proposes a timepiece of the type described above, characterized in that it is provided with an isolation lever, whose pivoting is controlled by the mobile part of the striking mechanism when the striking work is released, from an angular rest position to an angular isolation position, so as to cause the sliding pinion to slide from the winding position to an intermediate position, located axially between the winding position and time-setting position of said pinion.

Owing to the timepiece according to the invention, the risk of bad manipulations by the user are prevented since it is impossible to wind the timepiece during operation of the striking work, as the sliding pinion is neutralised. The timepiece according to the invention is therefore more reliable.

According to an advantageous embodiment of the invention, the isolation lever is biased elastically to abut against the mobile part of the striking mechanism so that the pivoting of the mobile part, when the striking work is released, causes the isolating lever to pivot from the rest position to the isolating position thereof. The isolating lever includes an isolating arm which controls the sliding of the sliding pinion to the intermediate position thereof while abutting against an element that is pivotably connected to the pull-out piece, said element preferably being a pin secured to the pivoting free end of the pull-out piece. These features allow the isolating function to be achieved in a simple and reliable manner with a minimum of parts.

The invention is particularly suited to a timepiece including a locking lever that cooperates via a first arm with a mobile part of the striking mechanism and via a second arm with one element of the time-setting mechanism such that, when the mobile part moves following the release of the striking work, the locking lever pivots towards the locked time-setting position wherein the time-setting mechanism is locked. According to an advantageous embodiment of this timepiece, the time-setting mechanism includes a control member that causes the locking lever to pivot to a locked striking work position, when the time-setting lever pivots to the time-setting position thereof and the locking lever includes locking means that cooperate with complementary means of the striking mechanism to prevent the latter from being released, in the striking work locked position.

Thus, the timepiece according to the invention prevents the risk of improper manipulations by the user since the striking work is prevented from being released during a time-setting operation and vice versa. Moreover, the same part, the locking lever, performs alternately two functions which are locking the striking work and locking the time-setting mechanism. The proposed solution thus makes the operation of the timepiece reliable with a minimum of parts.

According to another feature of the invention, the control member that causes the locking lever to pivot to the locked striking work position is arranged on the time-setting lever, which allows the pivoting of the time-setting lever to be directly linked to the locking of the striking work, without requiring an additional part to be arranged in the time-setting mechanism.

The invention applies in particular to the case where the striking mechanism includes a release lever that releases the striking work when it is pivoted from a rest position to a release position. Advantageously, the first arm of the locking lever includes a striking work locking hook, which in the locked striking work position, cooperates with a first hooking zone arranged on the release lever in order to lock the striking mechanism. The striking work is thus locked in a simple manner using a minimum of parts.

Preferably, the first hooking zone of the release lever includes a first control surface that cooperates with a first support surface arranged on the locking lever in order to cause the locking lever to pivot to the locked time-setting position thereof, when the release lever pivots to the release position thereof. Thus, the first hooking zone performs two functions, which are hooking with the striking work locking hook and controlling the pivoting of the locking lever to the locked time-setting position thereof.

According to an advantageous embodiment, the first hooking zone is formed by a hooking pin, which is arranged on the release lever and which is formed by the free end section of a pin secured to the release lever. This solution is particularly simple and easy to manufacture.

According to another feature of the invention, the second arm of the locking lever includes a time-setting locking hook, which, in the locked time-setting position, cooperates with a second hooking zone arranged on the time-setting lever so as to lock the time-setting mechanism. The time-setting mechanism is thus achieved in a simple manner, using a minimum of parts.

Preferably, the second hooking zone arranged on the time-setting lever includes a second control surface, which cooperates with a second support surface arranged on the time-setting locking hook so as to cause the locking lever to pivot to the second locked position thereof, when the time-setting lever pivots to the time-setting position. Thus, the second hooking zone performs two functions, which are hooking with the time-setting locking hook and controlling the pivoting of the locking lever to the locked striking work position.

According to an advantageous embodiment, the time-setting lever includes a hooking arm, which extends generally in a parallel plane to the plane of the locking lever and the second hooking zone is arranged at the free end of said hooking arm.

BRIEF DESCRIPTION OF THE DRAWINGS

Other features and advantages of the present invention will appear more clearly upon reading the following detailed description, made with reference to the annexed drawings, given by way of non limiting example and in which.

DETAILED DESCRIPTION OF THE PREFERRED EMBODIMENTS

In the following description, an orthogonal marking V, L, T, respectively defining the vertical, longitudinal and transverse orientations, are used in a non-limiting manner.

Figure 1:
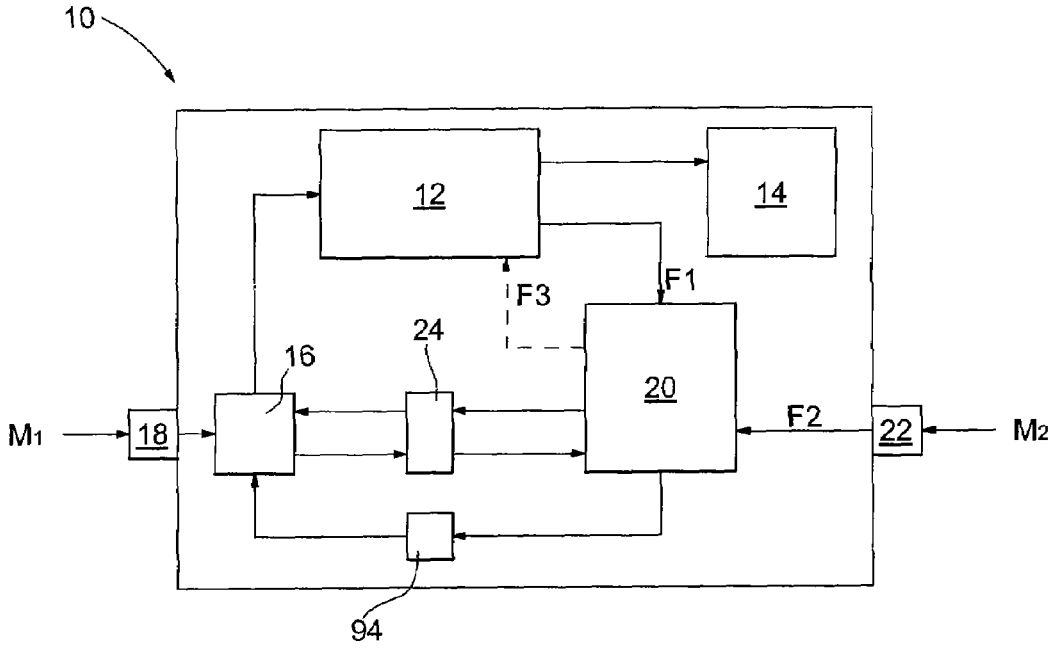
FIG. 1 is an operating diagram that shows the main elements of the timepiece according to the invention.

FIG. 1 shows a timepiece 10, such as a wristwatch. This timepiece 10 is fitted with a mechanical timepiece movement 12 controlling a display device 14 generally formed by hands.

Timepiece 10 also includes a time-setting mechanism 16, which is able to cooperate with timepiece movement 12 to change the time indicated by display device 14. Time-setting mechanism 16 is controlled by a first manual control member, such as a winding crown 18, on which a user can act manually M1.

Timepiece 10 further includes a striking mechanism 20, which can be released here, either automatically by timepiece movement 12, which is represented by arrow F1, or manually M2 via a second manual control member 22, which is represented by arrow F2. When the striking work is released, striking mechanism 20 will search in movement 12 for the information concerning the number of blows to strike, which is represented by arrow F3.

A locking lever 24 is inserted between the time-setting mechanism 16 and the striking mechanism 20 so as to prevent the user of time-setting mechanism 16 during release of the striking work.

According to a feature of the invention, locking lever 24 is also provided for locking striking mechanism 20 during a time-setting operation.

Time-setting mechanism 16, striking mechanism 20 and locking lever 24 will now be described in more detail with reference to FIGS. 2 to 4.

Figure 2:
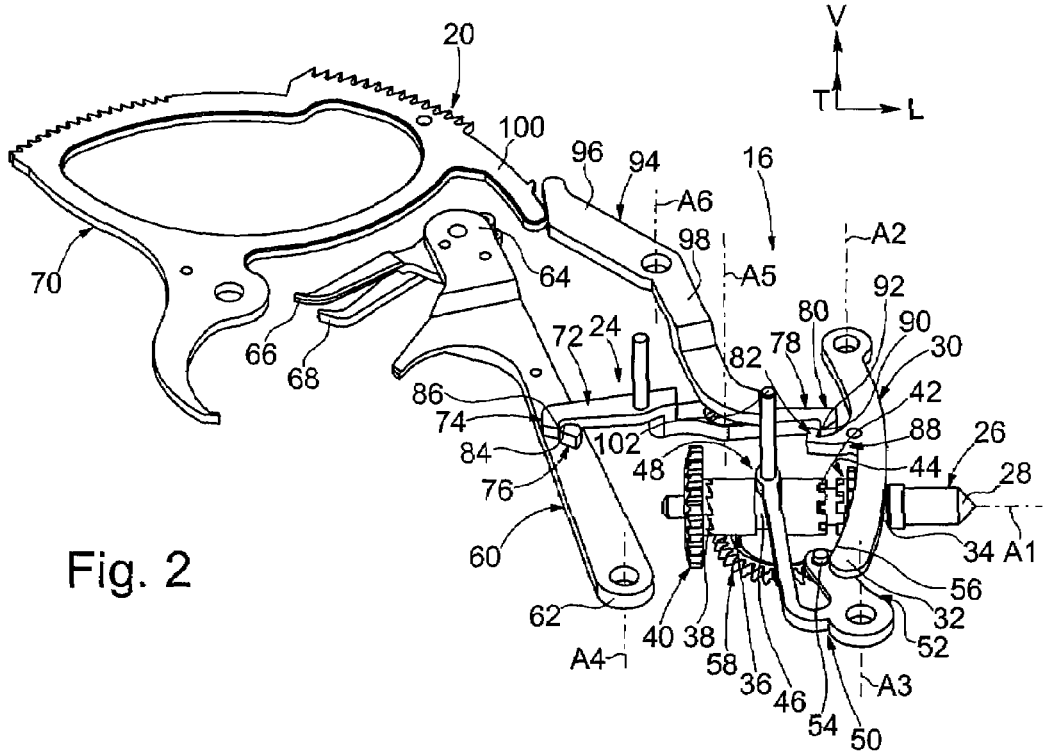
FIG. 2 is a perspective view that shows schematically the time-setting mechanism and one part of the striking mechanism of the timepiece of FIG. 1 in the rest state corresponding to a winding configuration.

Time-setting mechanism 16 includes a winding stem 26 sliding along a longitudinal axis A1 oriented, in a non-limiting manner, from the interior outwards, which corresponds to a left to right orientation in FIG. 2. Winding crown 18 is provided to be secured to the outer axial end 28 of winding stem 26 so as to allow the user, on the one hand, to control the rotation of winding stem 26 about its axis A1 and, on the other hand, to control the axial sliding (A1) of winding stem 26 between an axial winding position P0 which is shown in FIG. 2, and an axial time-setting position P1, which is shown in FIG. 3.

In the following description, the aforementioned pivoting axes are substantially vertical unless otherwise indicated.

A pivoting of a time-setting lever 30, which extends overall along a transverse direction above winding stem 26, is controlled by sliding winding stem 26. Time-setting lever 30 pivots about a fixed arbour A2, on the opposite side to the free end 32 thereof, and it is hinged in a groove 34 arranged in winding stem 26. Time-setting lever 30 pivots between an angular rest position $Pa_{rep}$, which is shown in FIG. 2, and an angular time-setting position $Pa_{mah}$, which is shown in FIG. 3.

A sliding pinion 36, which is coaxial and secured in rotation to winding stem 26, is guided so as to slide longitudinally on winding stem 26 between a winding position $PA_{eem}$, wherein the inner end 38 thereof meshes with a winding pinion 40 coaxial to winding stem 26, and a time-setting position $P_{mah}$, wherein the outer end 42 thereof meshes with a time-setting pinion 44 coaxial to winding stem 26. Sliding pinion 36 meshes here with winding pinion 40 via a toothing with wolf teeth and with time-setting pinion 44 via a square shaped toothing. Winding pinion 40 and time-setting pinion 44 are mounted to rotate freely on winding stem 26, sliding pinion 36 being used to connect one or other of the two pinions 40, 44 in rotation with winding stem 26.

The intermediate section of sliding pinion 36 is provided with an annular peripheral groove 46 which is provided for receiving the hinged free end 48 of a pull-out piece 50, which extends overall along a transverse direction above winding stem 26. Pull-out piece 50 pivots about a fixed arbour A3 and includes a control arm 52 fitted with a pin 54 which is drawn elastically to abut against an inner surface 56 arranged in the free end 32 of time-setting lever 30. The means that draw pull-out piece 50 elastically against time-setting lever 30 are not shown here but they could take any suitable form, such as the form of an elastic tongue. Pull-out piece 50 pivots between an angular winding position $PA_{rem}$, which corresponds to the winding position $P_{rem}$ of sliding pinion 36, and an angular time-setting position $PA_{mah}$, which corresponds to the time-setting position $P_{mah}$ of sliding pinion 36.

Thus, the pivoting of time-setting lever 30 to the time-setting position $PA_{mah}$ thereof, causes pull-out piece 50 to pivot to its own time-setting position $PA_{mah}$. This pivoting of pull-out piece 50 drives sliding pinion 36 towards its own axial time-setting position $P_{mah}$, via the free end 48 of pull-out piece 50.

Time-setting pinion 44 meshes with a time-setting wheel 58 which extends here in a horizontal plane, underneath winding stem 26, and which meshes in a known manner with a gear train of timepiece movement 12.

Figure 3:
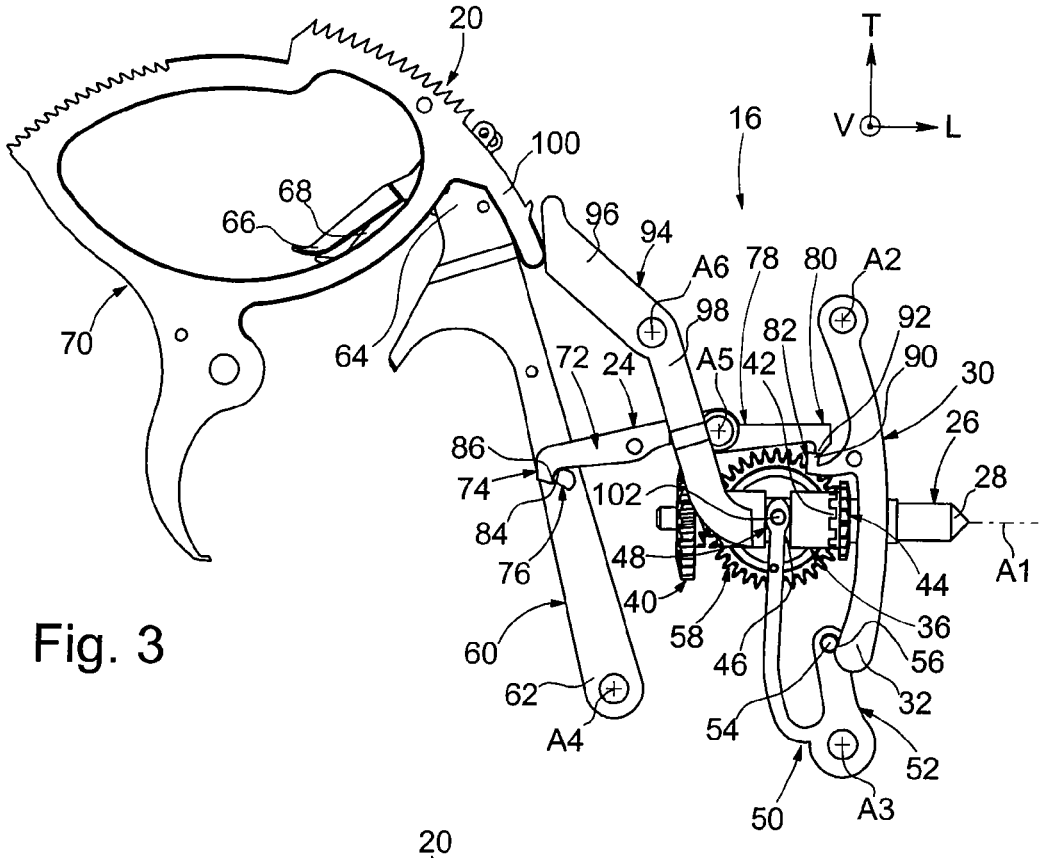
FIG. 3 is a top view that shows schematically the mechanisms of FIG. 2 when the time-setting mechanism is in the operating state and when the striking mechanism is in the locked state.
Figure 4:
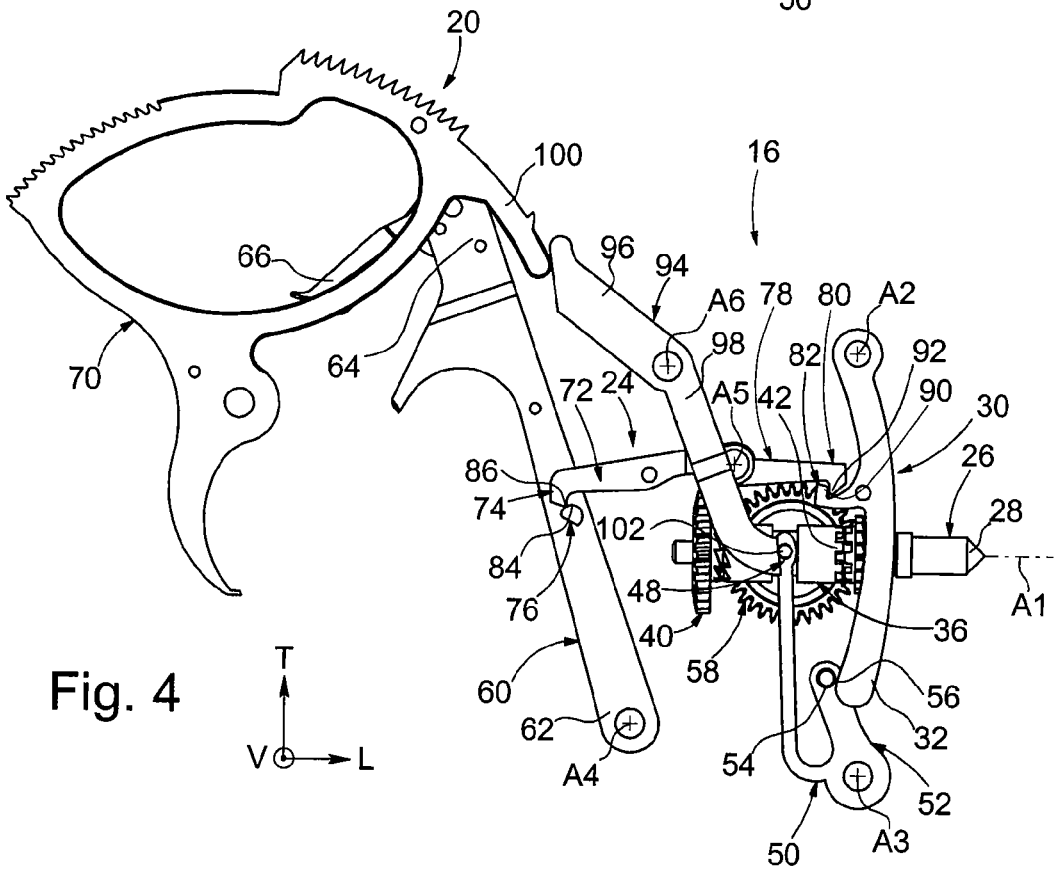
FIG. 4 is a similar view to that of FIG. 3, showing the mechanisms of FIG. 2 when the time-setting mechanism is in the locked state and the striking mechanism is released.

FIGS. 2 to 4 show only those parts of striking mechanism 20 that are necessary for comprehension of the invention.

Striking mechanism 20 includes a first mobile part formed by a release lever 60 which includes a first end 62 pivotably mounted about a fixed arbour A4 and a second free end 64, which here carries two clicks 66, 68 provided for cooperating with the gear train of striking mechanism 20 so as to release the same, when release lever 60 pivots from the angular rest position $P_i$ thereof, which is shown in FIGS. 2 and 3, to the angular release position $P_{ii}$ thereof, which is shown in FIG. 4.

Striking mechanism 20 includes a second mobile part formed by a minute rack 70, which pivots when the striking work is released, after release lever 60 has pivoted, so as to determine the number of blows to strike.

In accordance with an advantageous feature of the invention, the locking lever 24 is pivotably mounted about a fixed arbour A5 between a locked striking work position $P_{sv}$, which is shown in FIG. 3, and a locked time-setting position $P_{mahv}$, which is shown in FIG. 4. Locking lever 24 also includes an intermediate angular rest position $P_{rep}$, which is shown in FIG. 2, wherein neither the striking work, nor the time-setting mechanism is locked. Preferably, locking lever 24 includes an elastic element such as a spring (not shown) which returns the latter to the intermediate rest position $P_{rep}$.

According to the embodiment shown, locking lever 24 includes, on either side of the pivoting axis A5 thereof, a first arm 72 whose free end forms a striking work locking hook 74, which cooperates with a first hooking zone 76 arranged on release lever 60, and a second arm 78 whose free end forms a time-setting locking hook 80 which cooperates with a second hooking zone 82 arranged on time-setting lever 30.

Advantageously, the first hooking zone 76 includes a first control surface 84, which cooperates with a first associated support surface 86 arranged on locking lever 24 so as to cause locking lever to pivot to the locked time-setting position $P_{mahv}$, when release lever 60 pivots to the release position $P_{ii}$.

Preferably, a hooking pin 76 which is arranged on release lever 60 forms the first hooking zone 76 and the control surface 84 is formed by a cylindrical axial wall of hooking pin 76. Locking pin 76 is formed here by the free end section of a pin driven into release lever 60. The first support surface 86 is preferably formed by the free end of striking work locking hook 74.

Advantageously, time-setting lever 30 includes a hooking arm 88, which extends overall in a parallel plane to the plane of locking lever 24. The free end of hooking arm 88 has the shape of a hook and it forms the second hooking zone 82.

Preferably, the second hooking zone 82 includes a second control surface 90, which cooperates with a second support surface 92 arranged on time-setting locking hook 80 so as to cause locking lever 24 to pivot to the time-setting position $P_{sv}$, when time-setting lever 30 pivots to time-setting position $PA_{mah}$. The free end of time-setting locking hook 80 forms the second support surface 92 here.

Hooking arm 88 here forms a control member able to cause locking lever 24 to pivot to the striking work locked position $P_{sv}$.

According to another feature of the invention, timepiece 10 is fitted with an isolating lever 94 which will place sliding pinion 36 in an intermediate axial position $P_{int}$, between the winding position $P_{rem}$ and time-setting position $P_{man}$, when the striking work is released, so as to prevent timepiece movement 12 from being wound. Indeed, performing a winding operation during the operation of striking mechanism 20 could damage the elements of striking mechanism 20 or elements of timepiece movement 12. This winding operation could also produce an acceleration effect in the acoustic effect of the striking work, when the operation acts on a barrel used for the striking work, which is detrimental to the striking work quality.

Therefore, the pivoting of isolating lever 94 about a fixed arbour A6 is controlled by a mobile part of striking mechanism 20 when the striking work is released, from an angular rest position $P_a$, which is shown in FIGS. 2 and 3, to an angular isolating position $P_b$, which is shown in FIG. 4. More specifically, isolating lever 94 includes a control arm 96 and an isolating arm 98, control arm 96 being biased elastically to abut against a support arm 100 of minute rack 70 such that, when a striking work is released, the pivoting of minute rack 70 causes the isolating lever to pivot to the isolating position $P_b$ thereof.

When isolating lever 94 pivots from the rest position $P_a$ to the isolating position $P_b$ thereof, isolating arm 98 abuts against a pin 102 pivotably linked to the free end 48 of pull-out piece 50 so as to cause pull-out piece 50 to pivot about the axis A3 thereof, to an intermediate angular position corresponding to the intermediate axial position $P_{int}$ of sliding pinion 36, this position being illustrated in FIG. 4. Pin 102 is for example driven into the free end 48 of pull-out piece 50.

It will be noted that the pivoting of pull-out piece 50 to the intermediate angular position occurs here against the elastic return force by pin 54 that holds it abutting against time-setting lever 30.

We will now describe the operation of locking lever 24 and isolating lever 94 according to the invention from the rest configuration shown in FIG. 2.

In FIG. 2, time-setting mechanism 16 is in a configuration suitable for winding timepiece movement 12. The user can therefore move winding stem 26 in rotation about the axis A1 thereof, by using winding crown 22, which causes the rotation of winding pinion 40 via sliding pinion 36, the latter occupying the axial winding position $P_{rem}$.

In order to set the time, the user slides winding stem 26 outwards to the time-setting position P1, which causes time-setting lever 30 to slide from the rest position $PA_{rep}$ to the time-setting position $PA_{mah}$, as shown in FIG. 3.

The pivoting of time-setting lever 30 causes pull-out piece 50 to pivot, which drives sliding pinion 36, via the free end 48, to the time-setting position $P_{mah}$, where it meshes with time-setting pinion 44. Simultaneously, as hooking arm 88 moves outwards with time-setting lever 30, the second control surface 90 of hooking arm 88 cooperates with the second support surface 92, pushing back time-setting locking hook 80 to cause locking lever 24 to pivot, here in the anticlockwise direction.

When time-setting lever 30 has finished pivoting, locking lever 24 occupies the striking work locked position $P_{sv}$, striking work locking hook 74 cooperating with hooking pin 76 to block release lever 60 from pivoting, which prevents the striking work being released.

At the end of the time-setting operation, the user pushes back winding stem 26 to winding position P0, such that all of the mobile parts return to their initial positions shown in FIG. 2.

When the striking work is released, either automatically, or manually, release lever 60 pivots to the angular release position thereof. $P_i$, as shown in FIG. 4. This pivoting causes, via the first control surface 84 of hooking pin 76, which cooperates with the second support surface 86, locking lever 24 to pivot to the locked time-setting position $P_{mahv}$. In this second locked time-setting position $P_{mahv}$, time-setting locking hook 80 cooperates with the second hooking zone 82 of hooking arm 88 to block time-setting lever 30 from pivoting, which prevents any time-setting operation.

Simultaneously, during release of the striking work, the pivoting of minute rack 70 causes isolating lever 94 to pivot to the isolating position $P_b$ which, via pin 102 and pull-out piece 50, causes sliding pinion 36 to slide to the intermediate position $P_{int}$ thereof, to prevent any winding operation during the strike.

At the end of the strike, release lever 60 returns to the initial angular rest position $P_i$, such that all of the mobile parts return to their initial positions shown in FIG. 2.

According to an alternative embodiment (not shown), the pivoting of locking lever 24 to the locked time-setting position $P_{mahv}$ could be controlled by the pivoting of minute rack 70. In such case, the first arm 72 of locking lever 24 cooperates, directly or via an intermediate part, with a portion of minute rack 70.

Likewise, the pivoting of isolating lever 94 to the isolating position $P_b$ could be controlled by the pivoting of release lever 60. In such case, the control arm 96 of isolating lever 94 cooperates, directly or via an intermediate part, with a portion of release lever 60.

According to another variant (not shown), time-setting mechanism 16 could take a different form, in particular the mechanical connections between time-setting lever 30, pull-out piece 50, sliding pinion 36, and winding stem 26 could be achieved in a different manner, relative to the embodiment described with reference to the Figures.

What is claimed is:

1. A timepiece including a striking mechanism which includes a mobile part moving when the striking work is released, the timepiece further including a time-setting mechanism which cooperates with a winding stem, the time-setting mechanism including a time-setting lever, which pivots between an angular rest position and an angular time-setting position, and a pull-out piece, whose pivoting is controlled by the time-setting lever, between a winding position and a time-setting position, the pull-out piece controlling the axial sliding of a sliding pinion from a winding position to a time-setting position wherein an isolating lever is provided, whose pivoting is controlled by the mobile part of the striking mechanism when the striking work is released, from an angular rest position to an angular isolating position, so as to cause the sliding pinion to slide from the winding position thereof to an intermediate position, located axially between the winding position and the time-setting position.

2. The timepiece according to claim 1, wherein the isolating lever is biased elastically to abut against the mobile part of the striking mechanism such that the pivoting of the mobile part, when the striking mechanism is released, causes the isolating lever to pivot from the rest position to the isolating position thereof.

3. The timepiece according to claim 1, wherein the isolating lever includes an isolating arm which controls the sliding of the sliding pinion to the intermediate position thereof by abutting against an element that is pivotably linked to the pull-out piece.

4. The timepiece according to claim 3, wherein, in order to control the sliding of the sliding pinion, the isolating arm abuts against a pin secured to the free pivoting end of the pull-out piece.

5. The timepiece according to claim 1, of the type including a locking lever, which cooperates via a first arm with a mobile part of the striking mechanism and via a second arm with an element of the time-setting mechanism such that, when the mobile part moves after release of the striking work, the locking lever pivots to a time-setting locked position wherein the time-setting mechanism is locked, wherein the time-setting mechanism includes a control member which causes the locking lever to pivot to a locked striking work position, when the time-setting lever pivots to the time-setting position and wherein the locking lever includes locking means which cooperate with complementary means of the striking mechanism to prevent the release of the latter, in the locked striking work position.

6. The timepiece according to claim 5, wherein the control member which causes the locking lever to pivot to the locked striking work position is arranged on the time-setting lever.

7. The timepiece according to claim 5, wherein the striking mechanism includes a release lever which releases the striking work when it is made to pivot from a rest position to a release position, and wherein the first arm of the locking lever includes a striking work locking hook, which, in the locked striking work position, cooperates with a first hooking zone arranged on the release lever so as to lock the striking mechanism.

8. The timepiece according to claim 7, wherein the first hooking zone of the release lever includes a first control surface, which cooperates with a first support surface arranged on the locking lever so as to cause the locking lever to pivot to the locked time-setting position when the release lever pivots to the release position thereof.

9. The timepiece according to claim 7, wherein the first hooking zone is formed by a hooking pin which is arranged on the release lever.

10. The timepiece according to claim 5, wherein the second arm of the locking lever includes a time-setting locking hook, which, in the locked time-setting position, cooperates with a second hooking zone arranged on the time-setting lever so as to lock the time-setting function.

11. The timepiece according to claim 10, wherein the second hooking zone arranged on the time-setting lever includes a second control surface which cooperates with a second support surface arranged on the time-setting locking hook so as to cause the locking lever to pivot to the locked striking work position when the time-setting lever pivot to the time-setting position thereof.

12. The timepiece according to claim 10, wherein the time-setting lever includes a hooking arm which extends overall in a parallel plane to the plane of the locking lever and wherein the second hooking zone is arranged at the free end of said hooking arm.

13. The timepiece according to claim 6, wherein the second arm of the locking lever includes a time-setting locking hook, which, in the locked time-setting position, cooperates with a second hooking zone arranged on the time-setting lever so as to lock the time-setting function.

14. The timepiece according to claim 7, wherein the second arm of the locking lever includes a time-setting locking hook, which, in the locked time-setting position, cooperates with a second hooking zone arranged on the time-setting lever so as to lock the time-setting function.

15. The timepiece according to claim 8, wherein the second arm of the locking lever includes a time-setting locking hook, which, in the locked time-setting position, cooperates with a second hooking zone arranged on the time-setting lever so as to lock the time-setting function.

16. The timepiece according to claim 9, wherein the second arm of the locking lever includes a time-setting locking hook, which, in the locked time-setting position, cooperates with a second hooking zone arranged on the time-setting lever so as to lock the time-setting function.

* * * * *